US007838764B2

(12) United States Patent
Bolouri-Saransar et al.

(10) Patent No.: US 7,838,764 B2
(45) Date of Patent: Nov. 23, 2010

(54) COMMUNICATION CHANNELS WITH SUPPRESSION CORES

(75) Inventors: Masud Bolouri-Saransar, Orland Park, IL (US); David A. Dylkiewicz, Lockport, IL (US); Darren J. Reigle, Frankfort, IL (US)

(73) Assignee: Panduit Corp., Tinley Park, IL (US)

( * ) Notice: Subject to any disclaimer, the term of this patent is extended or adjusted under 35 U.S.C. 154(b) by 157 days.

(21) Appl. No.: 11/937,664

(22) Filed: Nov. 9, 2007

(65) Prior Publication Data

US 2008/0060841 A1 Mar. 13, 2008

Related U.S. Application Data

(63) Continuation of application No. 11/335,206, filed on Jan. 19, 2006, now Pat. No. 7,301,098.

(60) Provisional application No. 60/645,412, filed on Jan. 19, 2005.

(51) Int. Cl.
*H01B 11/06* (2006.01)

(52) U.S. Cl. ..... 174/36; 174/268

(58) Field of Classification Search ..... 174/250, 174/256, 268, 36

See application file for complete search history.

(56) References Cited

U.S. PATENT DOCUMENTS

| | | | | |
|---|---|---|---|---|
| 5,027,088 | A * | 6/1991 | Shimizu et al. | 333/1 |
| 5,058,172 | A | 10/1991 | Ross et al. | |
| 5,287,074 | A | 2/1994 | Meguro et al. | |
| 5,763,825 | A | 6/1998 | Gilliland | |
| 5,801,597 | A | 9/1998 | Carter et al. | |
| 5,838,216 | A | 11/1998 | White et al. | |
| 5,914,644 | A | 6/1999 | Carter et al. | |
| 6,007,368 | A | 12/1999 | Lorenz et al. | |
| 6,054,649 | A | 4/2000 | Uchida et al. | |
| 6,162,992 | A | 12/2000 | Clark et al. | |
| 6,252,163 | B1 | 6/2001 | Fujimori et al. | |

(Continued)

FOREIGN PATENT DOCUMENTS

EP 0844697 A2 5/1998

(Continued)

OTHER PUBLICATIONS

Fair-Rite Products Corp., "How to Choose Ferrite Components for EMI Suppression", Technical Information, 14th Edition, pp. 174-182, date unknown.

(Continued)

*Primary Examiner*—Chau N Nguyen
(74) *Attorney, Agent, or Firm*—Robert A. McCann; Zachary J. Smolinski

(57) ABSTRACT

Alien crosstalk suppression cores are used to decrease alien crosstalk in communications channels. Electrical communication cables may be provided with alien crosstalk suppression cores. The alien crosstalk suppression cores, which may be ferrite suppression cores, are placed separately on some or all of the twisted pairs within a communication cable. The alien crosstalk suppression cores reduce ANEXT and AFEXT in high-frequency communications when communication cables are installed near one another. Alien crosstalk suppression cores may also be incorporated into other communication channel components, such as on a PCB within a communication jack.

2 Claims, 8 Drawing Sheets

U.S. PATENT DOCUMENTS

| | | | | |
|---|---|---|---|---|
| 6,303,867 | B1 | 10/2001 | Clark et al. | |
| 6,633,000 | B2 | 10/2003 | Kuo | |
| 6,867,362 | B2 | 3/2005 | Cherniski et al. | |
| 7,153,168 | B2 * | 12/2006 | Caveney et al. | 439/676 |
| 7,309,261 | B2 * | 12/2007 | Caveney et al. | 439/676 |
| 7,384,315 | B2 * | 6/2008 | Caveney et al. | 439/676 |
| 2004/0055772 | A1 | 3/2004 | Tsutsui et al. | |
| 2004/0123994 | A1 | 7/2004 | Hohenwater et al. | |
| 2004/0129439 | A1 | 7/2004 | Tsutsui et al. | |

FOREIGN PATENT DOCUMENTS

| | | | |
|---|---|---|---|
| JP | 3-78984 | A | 4/1991 |
| JP | 04-129286 | * | 4/1992 |

OTHER PUBLICATIONS

Jameco Electronics, web page for EMI Line Cord Suppression Core w/Case (Jameco#: 317705) and catalog page No. 165 depicting product when link is clicked, 2 pages total, date unknown.

* cited by examiner

COMMUNICATION CHANNELS WITH SUPPRESSION CORES

CROSS-REFERENCE TO RELATED APPLICATION

This application is a continuation of U.S. patent application Ser. No. 11/335,206, filed Jan. 19, 2006 which claims the benefit of U.S. Provisional Application No. 60/645,412, filed Jan. 19, 2005. The above applications are incorporated herein by reference in their entireties.

FIELD OF THE INVENTION

The present invention is generally directed to communication channels and more specifically directed to communication channels having alien crosstalk suppression cores.

BACKGROUND OF THE INVENTION

Communication cables comprised of multiple twisted pairs of conductors are common, with four-pair cables being widely used. In high-speed data networks, crosstalk can result within communication cables and between nearby communication cables. Crosstalk occurring within a cable includes near-end crosstalk (NEXT) and far-end crosstalk (FEXT), and alien crosstalk occurring between cables includes alien near-end crosstalk (ANEXT) and alien far-end crosstalk (AFEXT). Suppression of alien crosstalk in communication channels is important, because alien crosstalk can reduce the signal-to-noise ratio in a communication channel and increase the channel's bit error rate. As communication bandwidth increases, the reduction of noise such as alien crosstalk in communication cables becomes increasingly important.

In high-bandwidth communication applications, communication cables are commonly installed alongside one another, and ANEXT and AFEXT can result between adjacent or nearby communication cables. ANEXT and AFEXT become more problematic at frequencies above 300 MHz, and ANEXT and AFEXT noise at high frequencies is present in high-speed data transmission systems such as 10 Gigabit Ethernet signaling. It is desirable to reduce alien crosstalk at frequencies greater than 300 MHz.

SUMMARY OF THE INVENTION

Improved communication channels are provided with alien crosstalk suppression cores.

According to one embodiment of the present invention, an improved communication patch cord includes alien crosstalk suppression cores.

According to some embodiments of the present invention, alien crosstalk suppression cores are placed on electrical communication patch cords at positions close to the ends of the patch cords.

Alien crosstalk suppression cores may be placed around specific pairs of conductors. For example, in one eight-conductor (four-pair) patch cord embodiment of the present invention, alien crosstalk suppression cores are placed on two pairs of conductors.

In some embodiments, alien crosstalk suppression cores may be placed on specific pairs of conductors. For example, in one embodiment, alien crosstalk suppression cores are placed on pair 1-2 and pair 7-8 of a four-pair patch cord.

Alien crosstalk suppression cores according to the present invention may be incorporated into other components of a communication channel, such as communication plugs.

According to some embodiments of the present invention, alien crosstalk suppression cores are comprised of ferrite material.

BRIEF DESCRIPTION OF THE DRAWINGS

FIG. **6*a* is a cross-sectional view of a printed circuit board showing ferrite cores through the printed circuit board.

DETAILED DESCRIPTION OF THE ILLUSTRATED EMBODIMENTS

ANEXT and AFEXT can result from unbalanced coupling between conductive pairs in a connector. In a twisted-pair channel with eight conductors, the conductors may be paired as follows:

Pair 1=fourth and fifth conductors;

Pair 2=first and second conductors;

Pair 3=third and sixth conductors; and

Pair 4=seventh and eighth conductors.

For example, in a twisted-pair channel in which pair 3 (the 3-6 pair, corresponding to the third and sixth conductors in an eight-conductor channel) is a crossover pair, being divided and placed on opposite sides of the central pair 1 in a connector, the coupling between pair 2 (i.e., the 1-2 pair) and the third conductor in the connector is greater than the coupling between pair 2 and the sixth conductor. Similarly, the coupling between pair 4 (i. e., the 7-8 pair) and the sixth conductor in a connector is greater than the coupling between pair 4 and the third conductor. Installing suppression cores, such as ferrite suppression cores, on specific twisted pairs in a communication channel—or on conductors associated with specific twisted pairs—can reduce alien crosstalk between communication channels.

Figure 1:
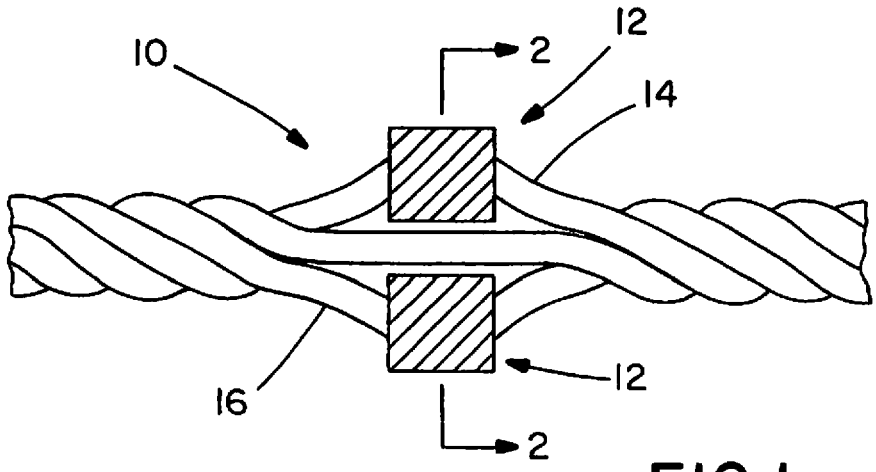
FIG. 1 is a side view of a communication patch cord according to one embodiment of the present invention.

The contributions from pair 2 and pair 4 to ANEXT and AFEXT may be reduced in some embodiments of the present invention by placing alien crosstalk suppression cores on those twisted pairs. FIG. 1 shows a patch cord 10 with alien crosstalk suppression cores 12 placed on the second twisted pair 14 and the fourth twisted pair 16. According to one embodiment, the alien crosstalk suppression cores 12 are ferrite cores.

Figure 2:
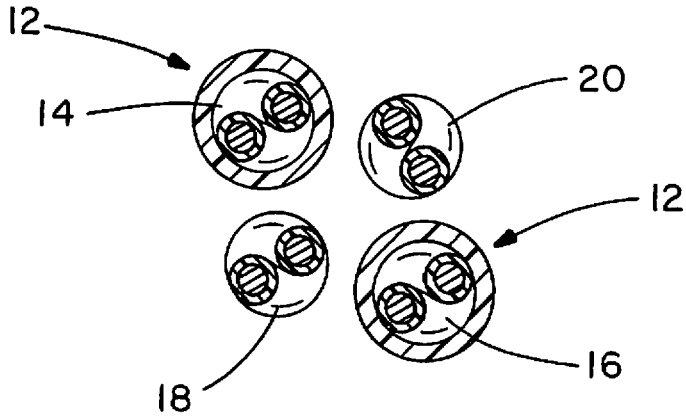
FIG. 2 is a cross-sectional view of a communication patch cord showing alien crosstalk suppression cores installed on two wire pairs of the patch cord.
Figure 3:
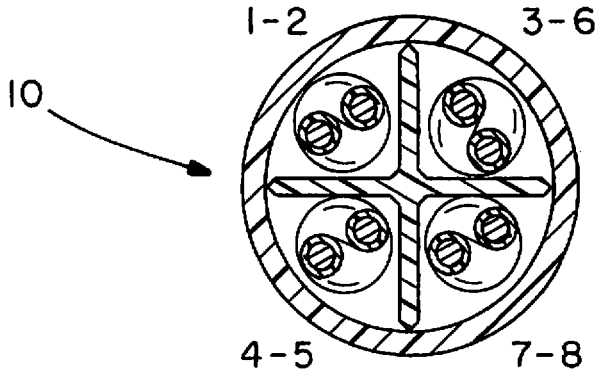
FIG. 3 is a cross-sectional view of a communication patch cord at a position where no alien crosstalk suppression cores are installed.

FIG. 2 shows a cross-sectional view of the patch cord 10 along the line 2-2 of FIG. 1. The alien crosstalk suppression cores 12 surround each of the second twisted pair 14 and the fourth twisted pair 16. The first twisted pair 18 and the third twisted pair 20 do not have alien crosstalk suppression cores. In another embodiment, all four twisted pairs may be separately provided with alien crosstalk suppression cores. The alien crosstalk suppression cores may be placed on a cable as close as practical to a plug or a jack. FIG. 3 shows a cross-section of the patch cord 10 at another portion where no alien crosstalk suppression cores are installed. Structures shown in FIGS. 1-3 may also be applied to a horizontal cable.

Figure 4:
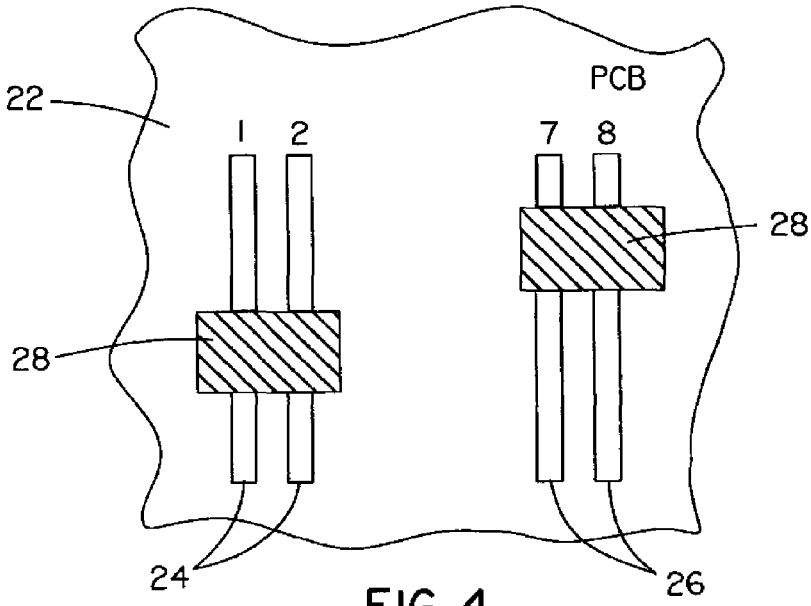
FIG. 4 is a top view of a printed circuit board surface with ferrite films placed atop conductive traces.
Figure 5:
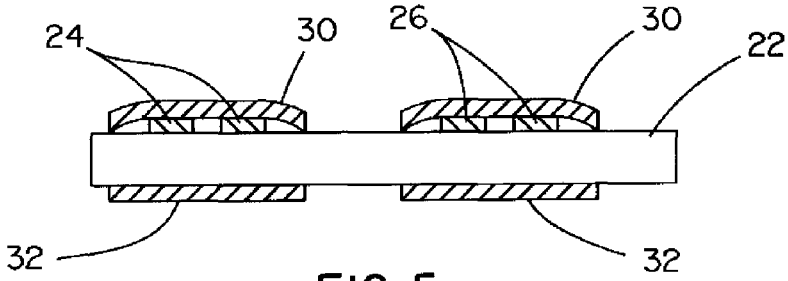
FIG. 5 is a cross-sectional view of a printed circuit board showing conductive traces on a printed circuit board with ferrite films.

The principles of the present invention may be used in other components of a communication channel. For example, a printed circuit board (PCB) within a communication jack may incorporate alien crosstalk suppression features. FIG. 4 is a top view of a PCB 22 with conductive traces corresponding to a second conductive pair 24 and a fourth conductive pair 26. Alien crosstalk suppressing films 28 are placed atop the traces 24 and 26. According to one embodiment, the alien crosstalk suppressing films 28 are ferrite films. FIG. 5 shows a cross-sectional view of a PCB 22 in which upper ferrite films 30 and lower ferrite films 32 are placed on opposite sides of the PCB 22 in the locations of the second conductive pair trace 24 and the fourth conductive pair trace 26.

Figure 6A:
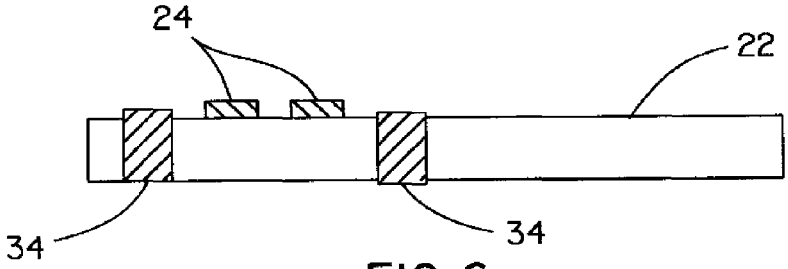
FIG. 6*b*** is a cross-sectional view showing ferrite cores and films on a printed circuit board.
Figure 6B:
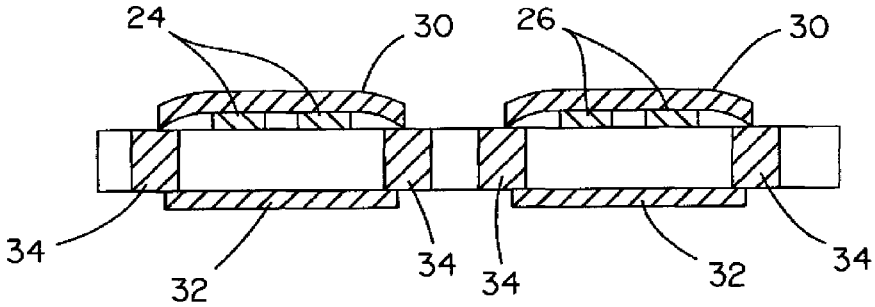

As shown in FIG. 6*a*, alien crosstalk suppression cores 34 may also be inserted through a PCB 22. Alien crosstalk suppression cores 34 may be used on their own, or they may be used in combination with ferrite films to surround the conductive traces as shown in FIG. 6*b*.

Figure 7:
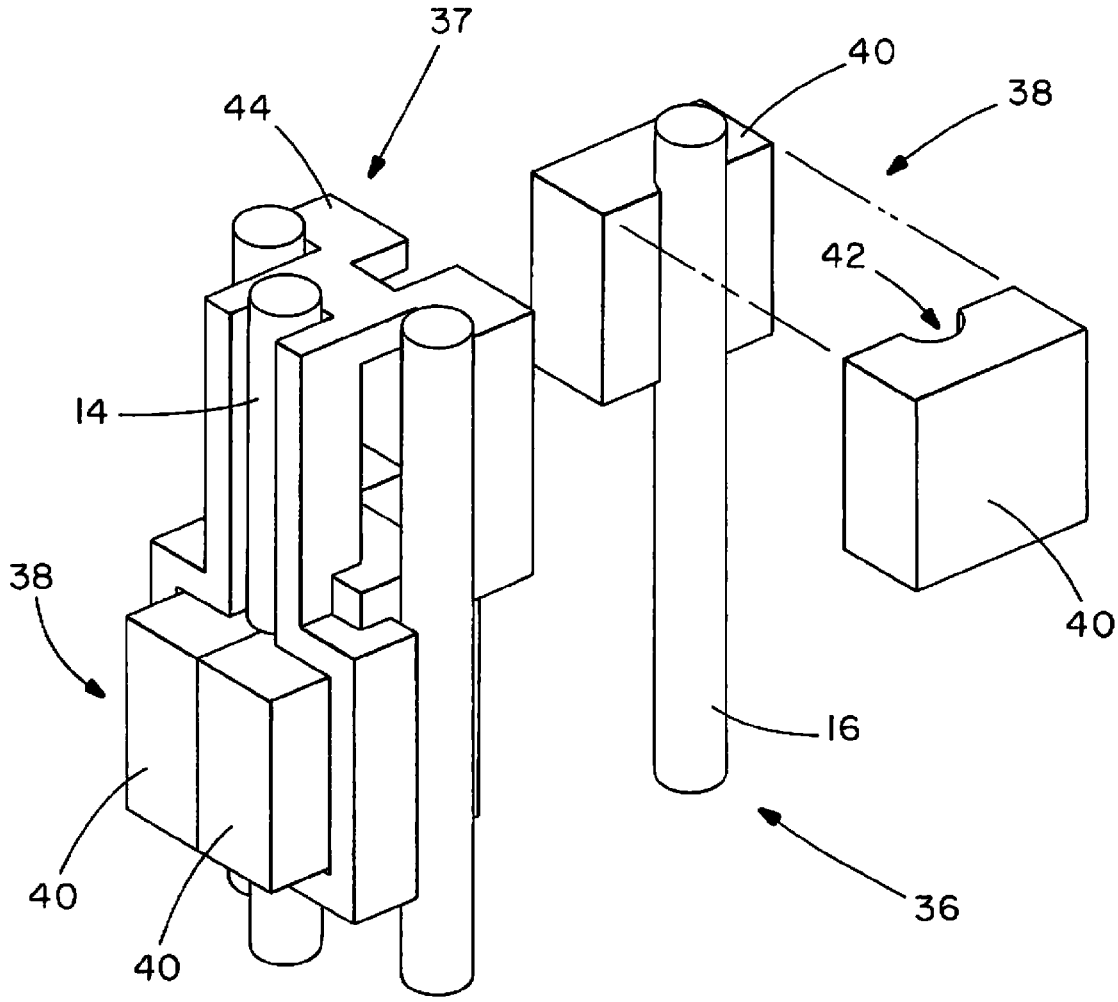
FIG. 7 is a partially exploded perspective view of a segment of a patch cord with an alien crosstalk suppression core assembly.

FIG. 7 is a partially exploded view of a segment 36 of a communication cable, such as a patch cord, with an alien crosstalk suppression assembly 37. Twisted pairs are represented simplified as single components. The segment 36 has alien crosstalk suppression cores 38 installed on a second twisted pair 14 and a fourth twisted pair 16 of the cable. Each of the alien crosstalk suppression cores 38 is comprised of two halves 40. The halves 40 of the alien crosstalk suppression cores 38 have depressions 42 to accommodate the twisted pairs 14 and 16. Two core halves 40 positioned around a single twisted pair of conductors surround the twisted pair. A housing 44 separates and routes the twisted pairs, including the twisted pairs without alien crosstalk suppression cores. The housing 44 further contains the alien crosstalk suppression cores 38 in desired positions and orientations around specific twisted pairs of cable.

The alien crosstalk suppression assembly 37 may be installed on a cable by first removing a predetermined length of jacketing from the cable at a predetermined distance from each end of the cable. Each set of twisted conductive pairs is separated from its initial lay and fanned out to open the center of the exposed section of cable. This is done only in the exposed section of cable, and is preferably done in a manner to reduce the disturbance to the pairs still within the cable jacket. Any additional components of the cable, such as a filler, a ripcord, or separator tapes, are removed from the exposed section of the cable. The housing 44 is inserted into the center of the exposed and fanned twisted pairs. The split alien crosstalk suppression cores 38 are assembled over specified twisted conductive pairs and inserted into the housing 44, and any conductive pairs without suppression cores are routed through the housing outside of the suppression cores. A durable outer housing is then manufactured, applied, or assembled over the exposed section of cable, housing 44, and alien crosstalk suppression cores 38 to contain, position, and protect the alien crosstalk suppression assembly.

Existing cable plants, including existing horizontal cabling, may be retrofitted with alien crosstalk suppression cores according to the present invention.

Figure 8:
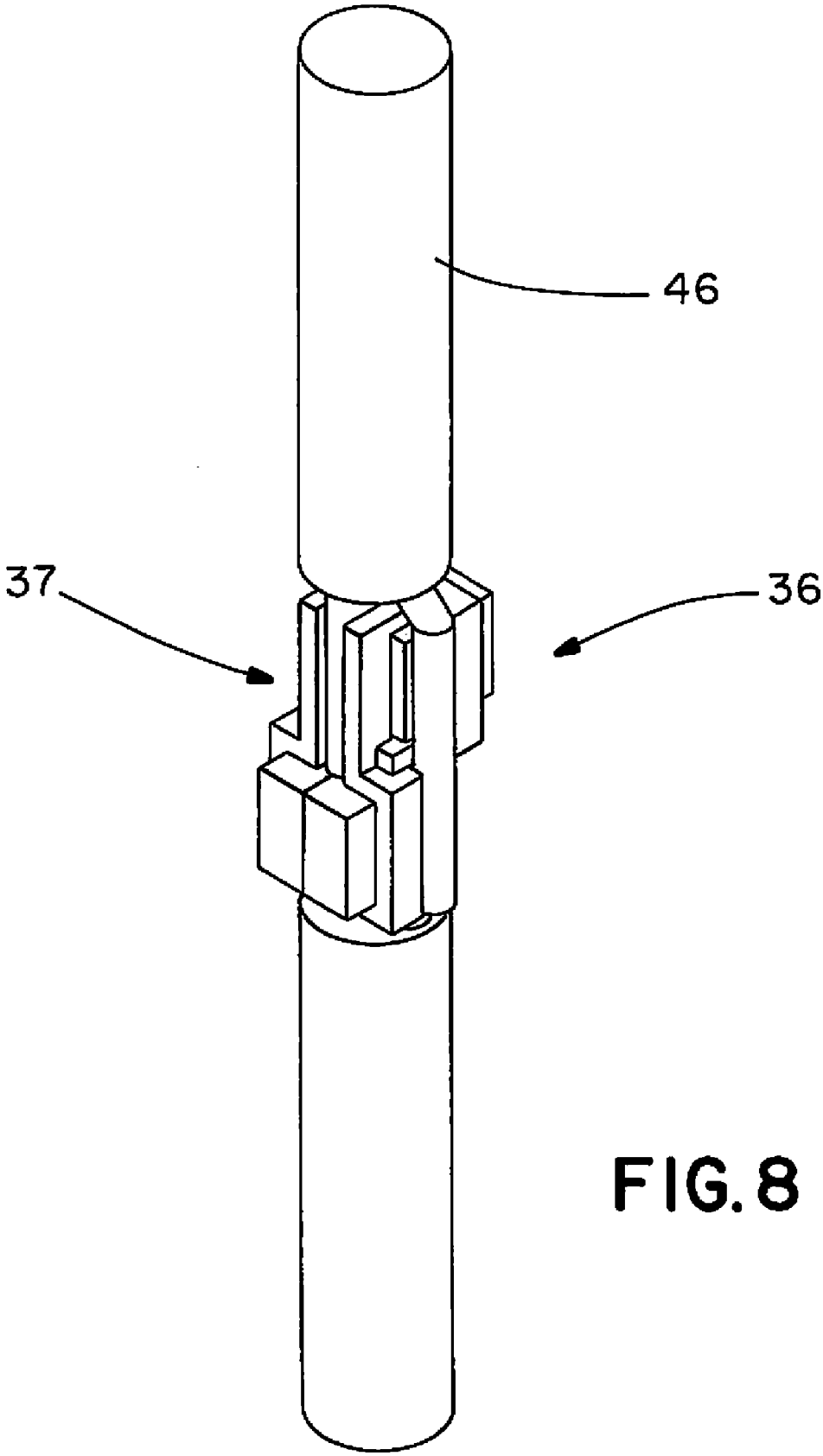
FIG. 8 is a perspective view of the alien crosstalk suppression core assembly of FIG. 7 installed within a segment of a patch cord.
Figure 9:
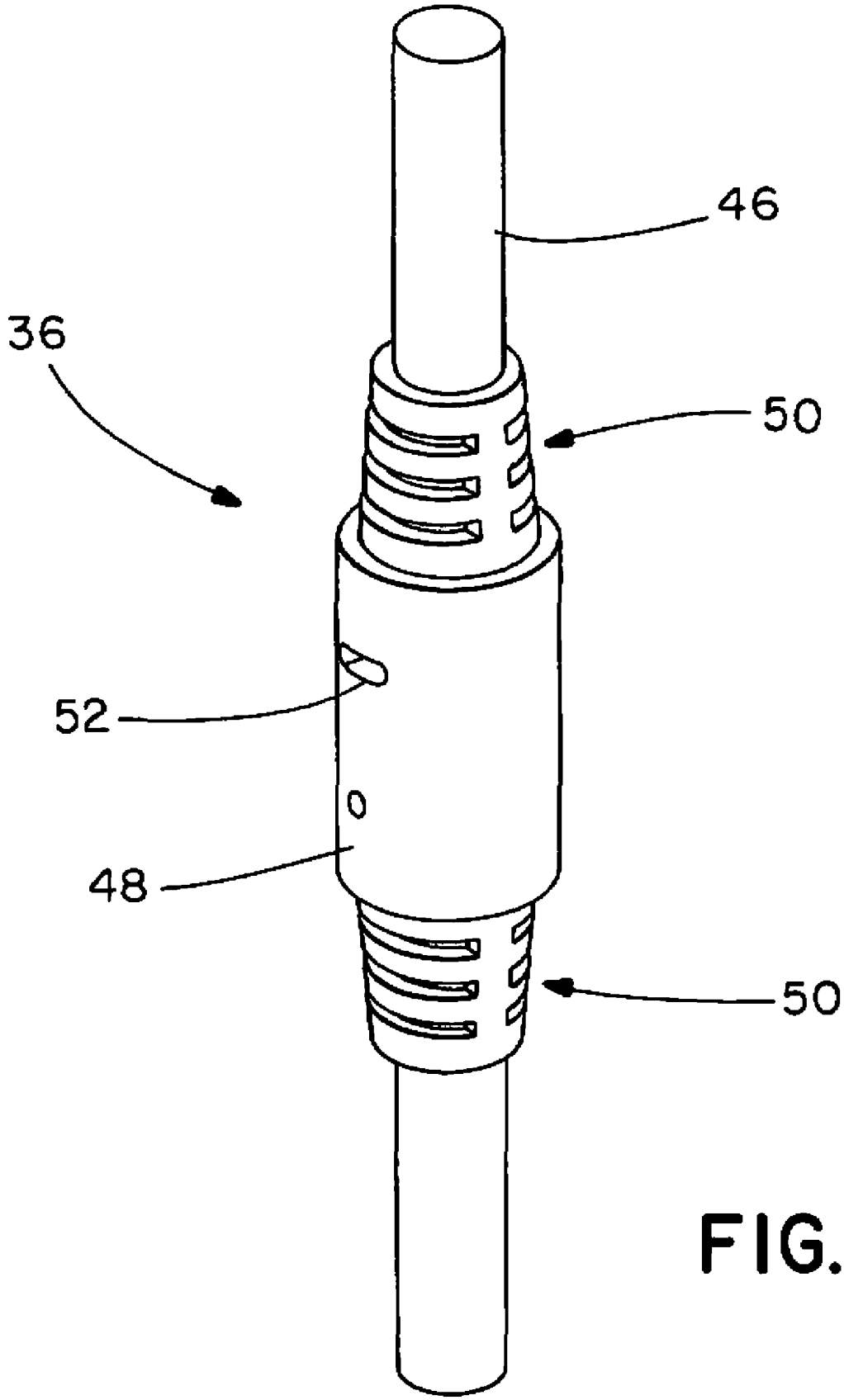
FIG. 9 is a perspective view of the patch cord of FIG. 8 with overmolding and strain relief features.

FIG. 8 shows the segment 36 of cable with the alien crosstalk suppression assembly 37. The segment 36 has the cable jacket 46 removed. FIG. 9 shows the segment 36 of the cable with an overmolded outer housing 48 covering the alien crosstalk suppression assembly. Strain relief members 50 are positioned on both ends of the overmolded outer housing 48. The strain relief members 50 provide adequate strain relief for the cut ends of the cable jacket 46 and provide adequate bend radius control over the modified portion of the cable to comply with standards specifications. The overmolded outer housing 48 may incorporate overmolding position and assembly features 52.

Outer housings according to the present invention may comprise, but are not limited to:

- The application of heat-shrink tubing or similar material over the exposed section of cable, housing, and suppression cores to contain, position, and protect the alien crosstalk suppression assembly;
- Direct manufacture of a thermoplastic material, via overmolding, over the exposed section of cable, housing, and suppression cores; or
- The use of individual thermoplastic components to provide a durable housing.

Figure 10:
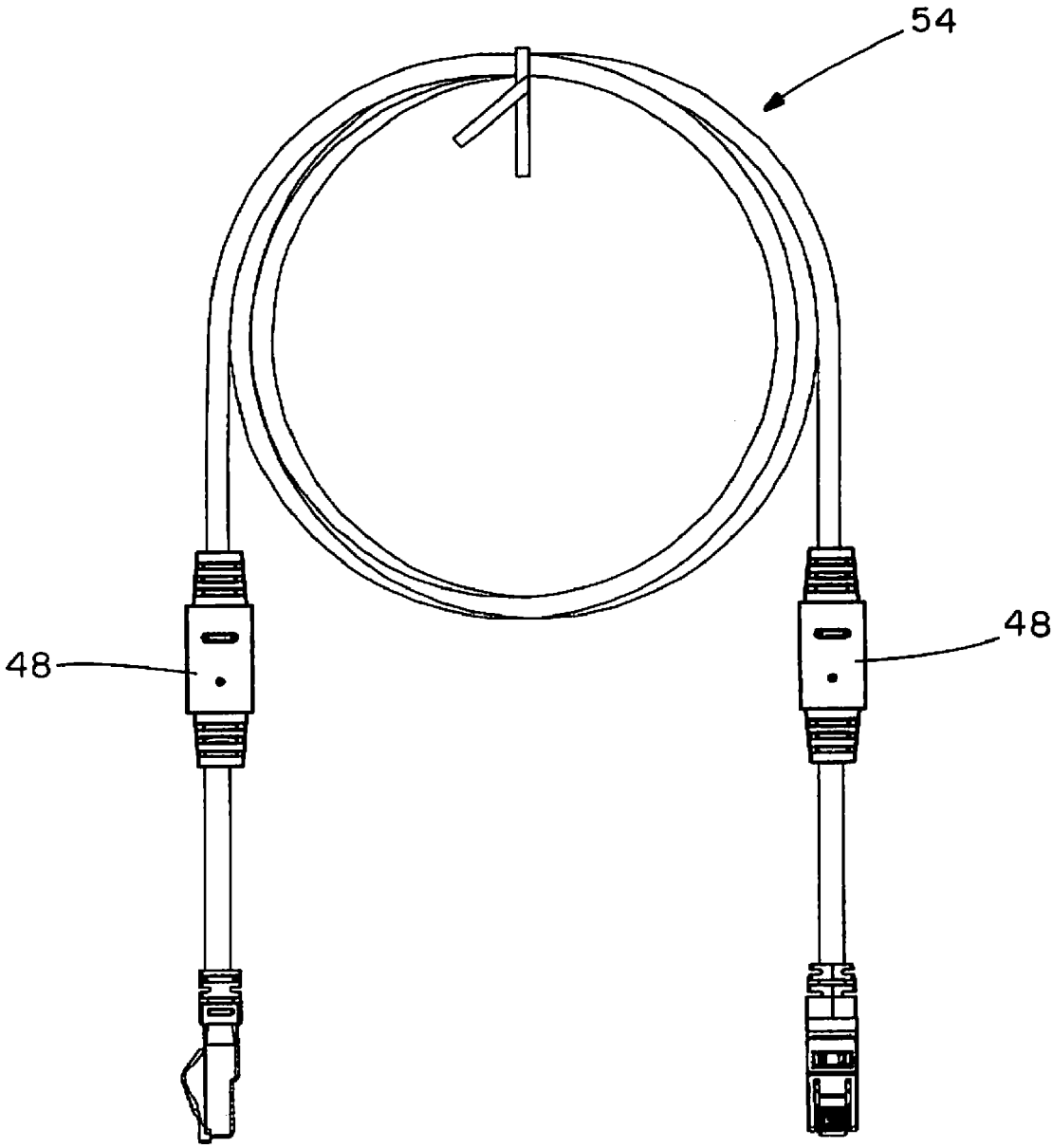
FIG. 10 is a plan view of a patch cord.

FIG. 10 is a plan view of a communication patch cord 54 with overmolded outer housings 48 covering alien crosstalk suppression assemblies.

Figure 11:
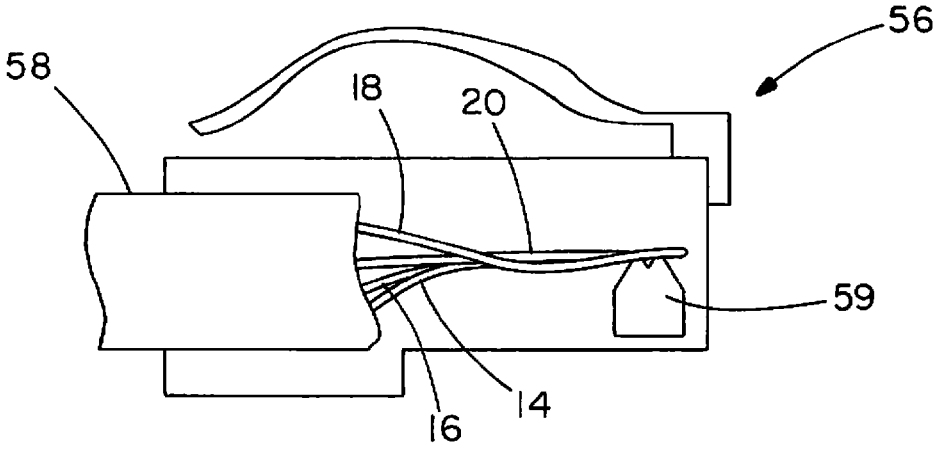
FIG. 11 is a cutaway side view of a communication plug.
Figure 12:
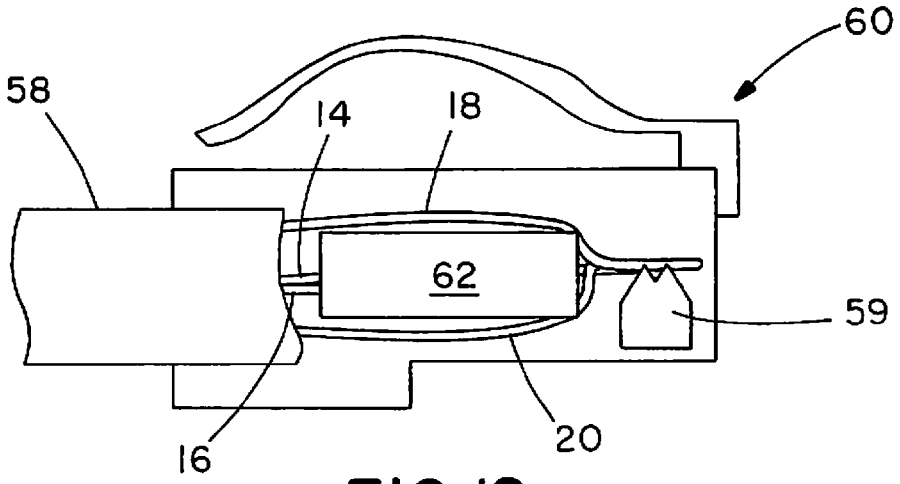
FIG. 12 is a cutaway side view of a communication plug with a suppression core.
Figure 13:
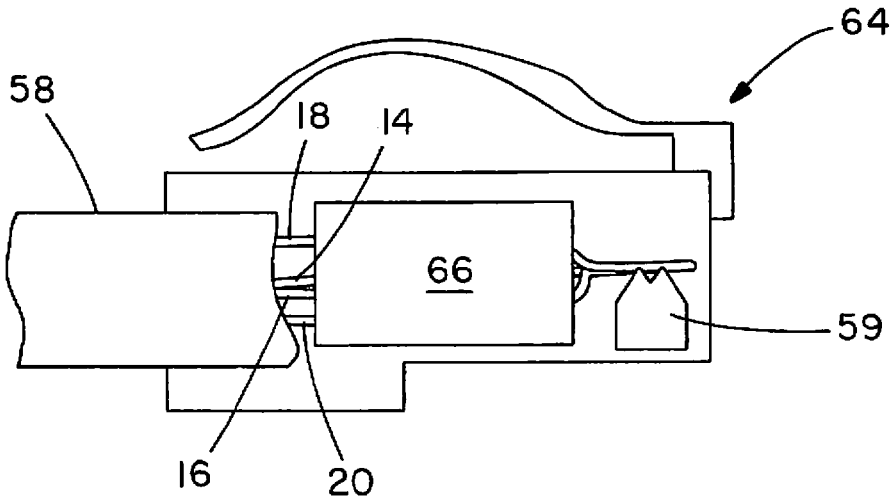
FIG. 13 is a cutaway side view of a communication plug with an alternative suppression core.

In some embodiments of the present invention, alien crosstalk suppression cores may be incorporated into communication plugs. FIG. 11 is a simplified cutaway side view of a communication plug 56, showing a communication cable 58 and first, second, third, and fourth twisted pairs 18, 14, 20, and 16. Insulation-displacement contacts (IDCs) 59 make contact with the conductors in the twisted pairs. FIG. 12 is a simplified cutaway side view of a communication plug 60 having an alien crosstalk suppression core 62 that surrounds the second and fourth twisted pairs 14 and 16 individually. FIG. 13 is a simplified cutaway side view of an alternative communication plug 64 having an alien crosstalk suppression core 66 that surrounds all four twisted pairs of the cable 58 individually.

Figure 14:
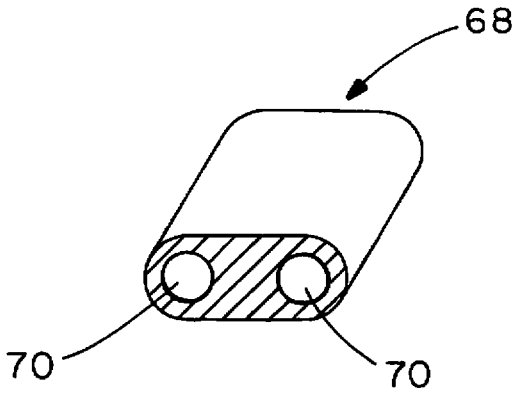
FIG. 14 is a perspective view of a suppression core.
Figure 15:
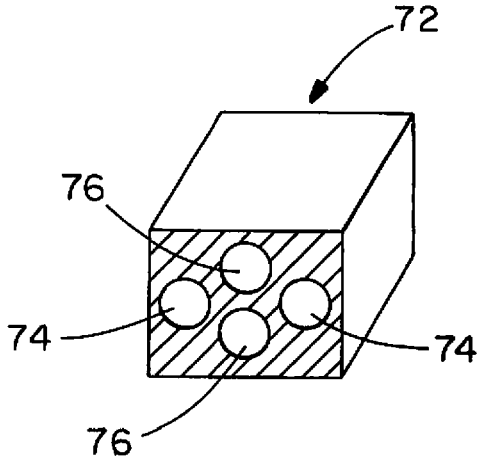
FIG. 15 is a perspective view of another suppression core.
Figure 16:
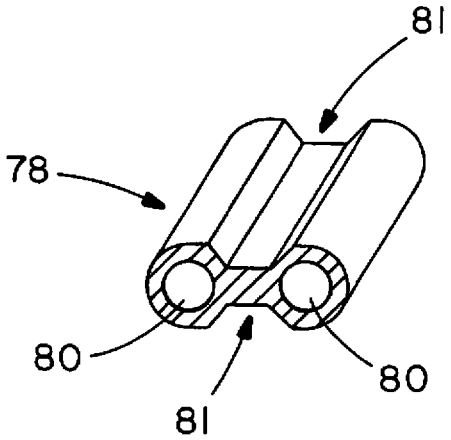
FIG. 16 is a perspective view of another suppression core.
Figure 17:
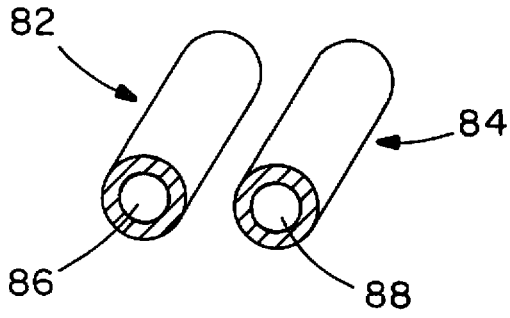
FIG. 17 is a perspective view of two suppression cores.

Different embodiments of alien crosstalk suppression cores that may be incorporated into communication plugs are shown in FIGS. 14-17. FIG. 14 shows an alien crosstalk suppression core 68 with two pathways 70 adapted to surround pairs 1-2 and 7-8 of a four-pair channel. The alien crosstalk suppression core 72 of FIG. 15 has a first pair of pathways 74 adapted to surround pairs 1-2 and 7-8 of a four-pair channel and a second pair of pathways 76 adapted to surround pairs 3-6 and 4-5 of a four-pair channel. FIG. 16 shows another alien crosstalk suppression core 78 having two pathways 80 adapted to surround pairs 1-2 and 7-8 of a four-pair channel. The alien crosstalk suppression core 78 of FIG. 16 has indentations 81. FIG. 17 shows a pair of alien crosstalk suppression cores 82 and 84, having first and second pathways 86 and 88. The pathways 86 and 88 are adapted to surround each of pairs 1-2 and 7-8 of a four-pair channel. The alien crosstalk suppression cores of FIGS. 14-17 may be incorporated into plugs, jacks, or both.

While the invention has been described with respect to patch cords, it is to be understood that alien crosstalk suppression cores according to the present invention may be applied to other types of communication cables, such as horizontal cabling. Further, in some embodiments of the invention, alien crosstalk suppression cores and films may be incorporated into wiring caps or plugs, or around insulation displacement contacts.

According to one embodiment of the present invention, alien crosstalk is reduced by incorporating alien crosstalk suppression cores into patch cords, horizontal cables, plugs, and jacks of communication channels.

While particular embodiments and applications of the present invention have been illustrated and described, it is to be understood that the invention is not limited to the precise construction and compositions disclosed herein, and that various modifications, changes, and variations may be apparent from the foregoing descriptions without departing from the spirit and scope of the invention.

The invention claimed is:

1. A printed circuit board for use in a communications connector, said printed circuit board comprising:

at least two pairs of conductive traces; and a first alien crosstalk suppressing film disposed proximate a first of said pairs of conductive traces; a second alien crosstalk suppressing film disposed proximate the first of said pairs of conductive traces on an opposite side of said printed circuit board from said first alien crosstalk suppressing film; and a pair of alien crosstalk suppression cores inserted through said printed circuit board between said first and second alien crosstalk suppressing films, thereby surrounding said first of said pairs of conductive traces to reduce alien crosstalk between communication channels.

2. The printed circuit board of claim 1 further comprising a third alien crosstalk suppressing film disposed proximate a second of said pairs of conductive traces; a fourth alien crosstalk suppressing film disposed proximate the second of said pairs of conductive traces on an opposite side of said printed circuit board from said third alien crosstalk suppressing film; and a second pair of alien crosstalk suppression cores inserted through said printed circuit board between said third and fourth alien crosstalk suppressing films, thereby surrounding said second of said pairs of conductive traces to reduce alien crosstalk between communication channels.

* * * * *